United States Patent [19]

Takahashi

[11] Patent Number: 4,781,887

[45] Date of Patent: Nov. 1, 1988

[54] PRODUCTION OF STEELS CONTAINING LOW MELTING POINT METALS

[75] Inventor: Akira Takahashi, Muroran, Japan

[73] Assignee: Nippon Steel Corporation, Tokyo, Japan

[21] Appl. No.: 117,092

[22] Filed: Nov. 5, 1987

[30] Foreign Application Priority Data

Nov. 14, 1986 [JP] Japan ..... 61-269587

[51] Int. Cl.[4] ..... C22C 33/00

[52] U.S. Cl. ..... 420/129; 266/265; 420/86

[58] Field of Search ..... 420/86, 129; 266/265

[56] References Cited

U.S. PATENT DOCUMENTS 3,322,530 5/1967 Nakamura ..... 420/129

3,756,805 9/1973 Ormaechea ..... 420/86

*Primary Examiner*—Peter D. Rosenberg

*Attorney, Agent, or Firm*—Wenderoth, Lind & Ponack

[57] ABSTRACT

A method of producing a steel alloy containing lead or bismuth which includes fluorine molten lead or bismuth through a hollomed stopper rod positioned above a nozzle opening in the bottom of a vessel containing molten steel.

4 Claims, 1 Drawing Sheet

PRODUCTION OF STEELS CONTAINING LOW MELTING POINT METALS

BACKGROUND OF THE INVENTION

1. Field of the Invention

The prsent invention relates to production of free cutting steels, more particularly a method for producing steels containing low melting point metals, such as free cutting steels.

2. Description of the Related Art

Free cutting properties of steels have been conventionally achieved by adding various elements which give the steel required free cutting properties. In particular, addition of low melting point metals, such as lead and bismuth, to free cutting steels containing relatively large amounts of sulfur, phosphorus, calcium etc. can further improve the free cutting properties of these steels, yet with less possibilities of lowering their mechanical properties.

The conventional method for adding these low melting point metals to molten steel has been such that granules of these addition metals are blown into molten steel or into a stream of molten steel by utilizing solid-gas pressure transfer system using inert gas such as argon gas. However, this conventional method has been confronted with a problem that much of the addition metal in gaseous state escapes together with the exhaust of the blowing gas, hence causing vigorous smoking.

The above problem is caused by the fact that these low melting point metal elements have their boiling point temperature around the temperature of the molten steel to which they are added. In the case of Pb, excessively added Pb, due to its large specific gravity and small solubility into the molten steel, precipitates in the molten bath to produce residues containing a large amount of Pb. Also various complicated considerations are required for treating the Pb containing residues.

Further, in order to obtain consistency in the production quality and production yield etc., it is important to achieve an accurate and uniform dispersion of the additive metals into the molten steel bath.

For these purposes, the present inventors proposed in Japanese Laid-Open Patent Application No. Sho 59-208048 a method which comprises pumping molten low melting point metals into a side wall of a nozzle which pours the molten steel from a ladle into a tundish in a continuous casting process.

Another related art as disclosed in Japanese Laid-Open Patent Application No. Sho 54-94437 teaches to spout solid steel granulars through a hollowed stopper rod positioned just above the tundish nozzle so as to introduce the steel granulars into the molten steel stream by the suction action of the nozzle.

However, these prior arts have the following problems. Thus in the art disclosed in Japanese Laid-Open Patent Application No. Sho 59-208048, as the molten low melting point metal is delivered through a pipe into a side wall of the tapping nozzle, a certain pressure is required and pressure means such as a pump is necessary, which will increase the capital cost and maintenance cost, and further as the molten metal is pumped under pressure, there is a danger that the molten low melting point metal leaks through the joint between the pipe and the side wall of the nozzle.

Meanwhile the art disclosed in Japanese Laid-Open Patent Application No. Sho 54-94437 has the problem that a uniform mixture of molten steel cannot be obtained because the steel granulars are added to the molten steel through the hollowed stopper rod of the tundish to cool and solidify the molten steel.

SUMMARY OF THE INVENTION

Therefore, the object of the present invention is to provide a method which can overcome the aforementioned problems of the prior arts.

The method according to the present invention is particularly useful for production of steels containing low melting point metals by continuous casting process, and is characterized in that the low melting point metal is preliminarily melted and this molten metal is dropped through a hollowed stopper rod of a molten steel vessel, such as a ladle and tundish, into a molten steel contained therein.

DESCRIPTION OF THE PREFERRED EMBODIMENTS

The present invention will be better understood from the following description of preferred embodiments of the present invention with reference to the accompanying drawing.

BRIEF DESCRIPTION OF THE DRAWING

The accompanying drawing schematically shows the apparatus for performing the present invention.

In this embodiment, a tundish is used as the molten steel vessel, and the molten low melting point metal is poured through a hollowed stopper rod.

Figure 1:
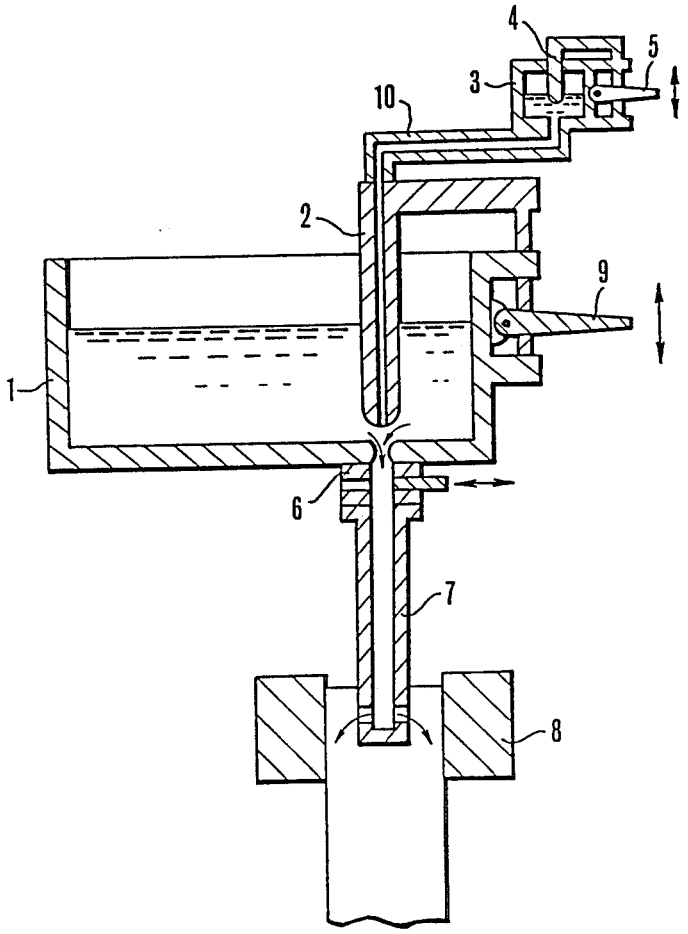

In the drawing, the tundish is shown by the numerical reference 1, and the hollowed stopper rod for tapping the molten steel from the tundish is shown by 2. The numerical reference 3 represents the vessel for containing the molten low melting point metal, 4 represents the stopper rod for tapping the molten low melting point metal from the vessel 3. The stopper rod 4 is operated by the operation lever 5 so as to control the amount of the molten metal to be tapped into the molten steel in the tundish. The numerical reference 6 represents the sliding nozzle assembly of the tundish, 7 represents the immersion nozzle, 8 is the mold, 9 is the operation lever for operating the stopper rod 2, and 10 represents the pipe connecting between the vessel 3 and the stopper rod 2.

The vessel 3 for the molten low melting point metal is located above the stopper rod 2 of the tundish 1 and connected thereto by the pipe 10. Although the pouring hole of the low melting point metal vessel 3 is shown in the drawing to deviate from the axial line of the stopper rod 2 of the tundish 2, the vessel 3 may be located right above the stopper rod so as to align the stopper rod, the pipe 10 and the pouring hole of the vessel 3 containing the molten low melting point metal.

As the stopper rod is moved up and down by the operation lever 9 so as to permit and stop the pouring of the molten steel from the tundish and to control the pouring amount, the pipe connecting between the stopper rod 2 and the vessel 3 is flexible so as to follow the movement of the stopper rod, or both the vessel 3 containing the molten low melting point metal and the pipe 10 may be moved up and down in synchronism with the movement of the stopper rod 2.

Meanwhile the molten metal contained in the vessel 3 is poured from the vessel in controlled amounts by the operation of the stopper rod 4 which is moved up and down by the operation lever 5. The low melting point metal poured from the vessel 3 flows down due to its high specific gravity through the pipe 10 and the stoper rod 2 into the molten steel and uniformly mixed therewith, and then poured into the mold 8 through the sliding nozzle 6 and the immersion nozzle 7.

The molten low melting point metal is dropped from the stopper rod into the molten steel while the stopper rod moves up and down, or while it is at a position above the nozzle opening of the tundish. In this way the low melting point metal can be uniformly mixed with the molten steel.

For production of Pb-containing free cutting steel, the stopper 4 is operated by the operation lever 5 so as to introduce the molten Pb into the molten steel to give 0.05–0.3% Pb content. As the molten Pb can drop by its gravity, the flowing rate of the molten Pb can be controlled only by adjusting the opening (lifting) of the stopper.

It is preferable that the low melting point metal drops into the molten steel at a position right above the nozzle opening of the tundish where the molten steel swirls into the nozzle opening so that the low melting point metal is mixed into the molten steel more uniformly and in a shorter time by virtue of the swirling action of the molten steel.

Further as the low melting point metal is allowed to flow down by gravity from the vessel through the pipe and the hollowed stopper rod of the tundish into the molten steel contained in the tundish, no special means for pressurizing the low melting point metal flow is required.

What is claimed is:

1. A method for producing a steel containing a low melting point metal selected from the group consisting of Pb and Bi, comprising:

maintaining the low melting point metal in a molten state in a vessel; and allowing a controlled amount of the molten low melting point metal to flow down through a hollowed stopper rod positioned above a nozzle opening in the bottom of a second vessel containing molten steel, into the molten steel contained in the second vessel.

2. A method according to claim 1, wherein the molten low melting point metal drops from the hollowed stopper rod into the molten steel while the stopper rod is moving up and down.

3. A method according to claim 1, herein the molten low melting point metal drops from the hollowed stopper rod into the molten steel at a position where the molten steel swirls into a nozzle opening of the molten steel vessel.

4. A method according to claim 1, wherein the molten low melting point metal drops from the hollowed stopper rod while the stopper rod is at an upward position above a nozzle opening of the molten steel vessel.

* * * * *